United States Patent [19]

Paoli et al.

[11] 3,971,614

[45] July 27, 1976

[54] ELECTRICAL CONNECTOR WITH MEANS FOR MAINTAINING A CONNECTED CONDITION

[75] Inventors: Alfred Paoli; Bipin J. Shah, both of Chicago, Ill.

[73] Assignee: Akzona Incorporated, Asheville, N.C.

[22] Filed: Nov. 3, 1972

[21] Appl. No.: 303,339

[52] U.S. Cl. ..... 339/89 R; 151/13; 151/41; 285/85; 285/89; 339/DIG. 2

[51] Int. Cl.[2] ..... H01R 13/54

[58] Field of Search ..... 339/89, 90, DIG. 2; 151/13, 41, 39; 285/81, 84–86, 89, 92

[56] References Cited

UNITED STATES PATENTS

| | | | |
|---|---|---|---|
| 718,336 | 1/1903 | Freund | 151/13 |
| 957,504 | 5/1910 | Frenot | 151/41 |
| 1,011,871 | 12/1911 | Smoke | 151/13 |
| 1,048,039 | 12/1912 | Church | 151/13 |
| 2,728,895 | 12/1955 | Quackenbush et al. | 339/89 R |
| 2,829,358 | 4/1958 | Testori | 339/89 M |
| 3,380,505 | 4/1968 | Heath | 151/41 |
| 3,390,900 | 7/1968 | McCormick et al. | 285/89 X |
| 3,517,371 | 6/1970 | Buckley | 339/89 C |
| 3,611,260 | 10/1971 | Colardeau et al. | 339/89 R |
| 3,646,495 | 2/1972 | Cowmeadow | 339/89 C |
| 3,663,926 | 5/1972 | Brandt | 339/89 R |

FOREIGN PATENTS OR APPLICATIONS

| | | | |
|---|---|---|---|
| 9,486 | 4/1910 | United Kingdom | 151/39 |

*Primary Examiner*—Roy D. Frazier
*Assistant Examiner*—Lawrence J. Staab
*Attorney, Agent, or Firm*—Hill, Gross, Simpson, Van Santen, Steadman, Chiara & Simpson

[57] ABSTRACT

An electrical connector incorporates a plug shell, a receptacle shell, a coupling nut for releasably interconnecting the plug shell together with the receptacle shell, and means for selectively impeding the coupling nut from being rotated in its decoupling direction. The latter means takes the form of interlocking splines provided on the plug shell, on the coupling nut, and on a coupling sleeve which surrounds the coupling nut. An alternative form uses a spring member urged against a cam surface provided on the end of the coupling nut.

5 Claims, 25 Drawing Figures

Fig. 11
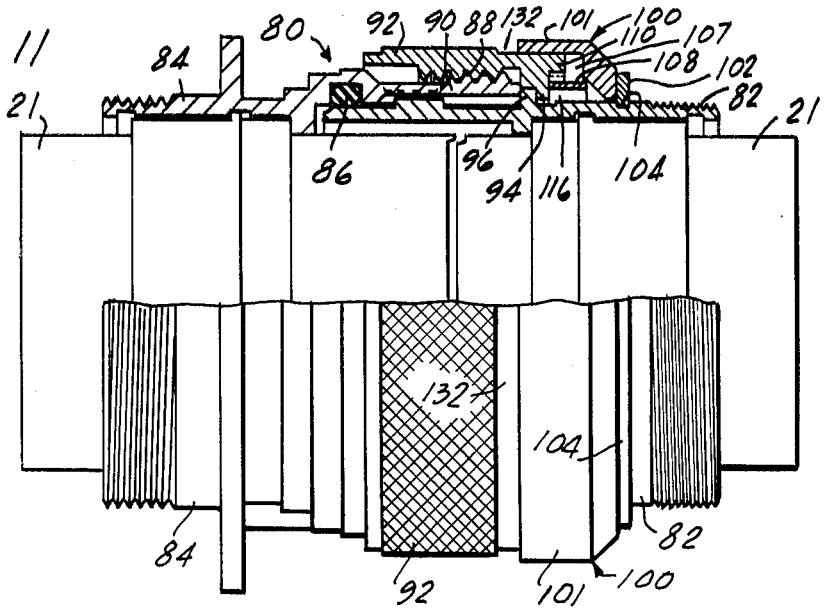
Fig. 12
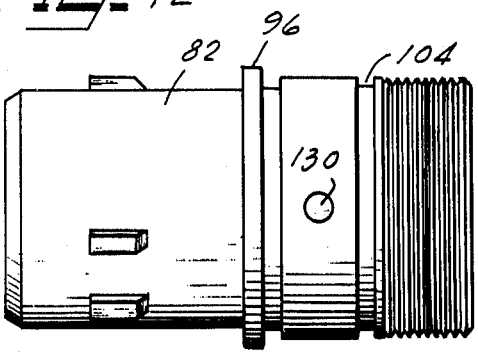
Fig. 13
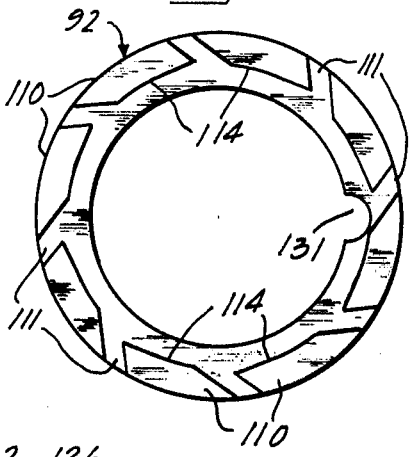
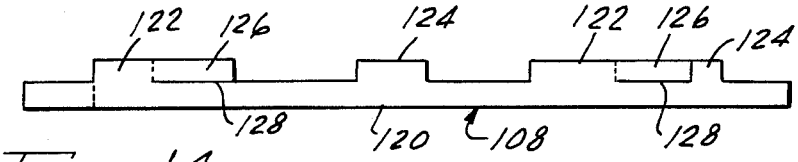
Fig. 14
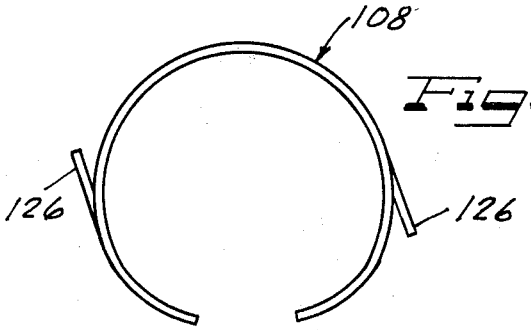
Fig. 15

Fig. 18
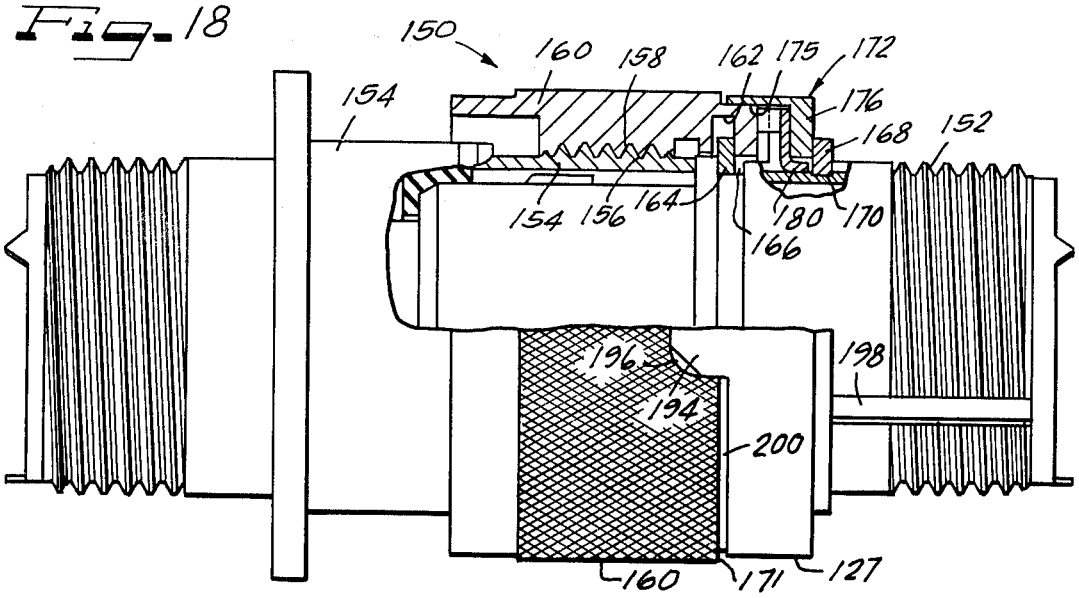
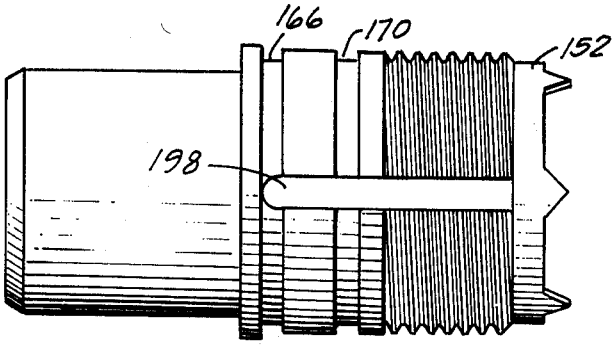
Fig. 19
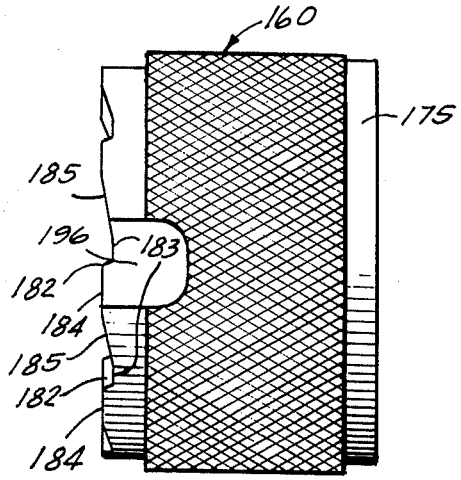
Fig. 20
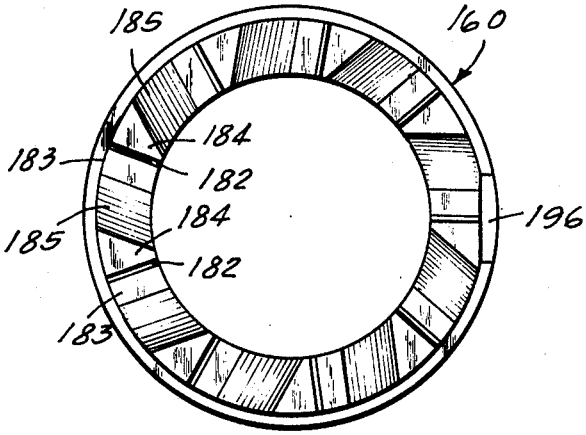
Fig. 21

Fig. 22
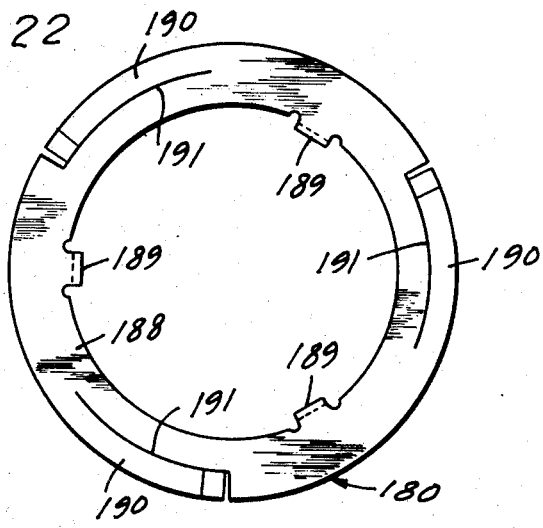
Fig. 23
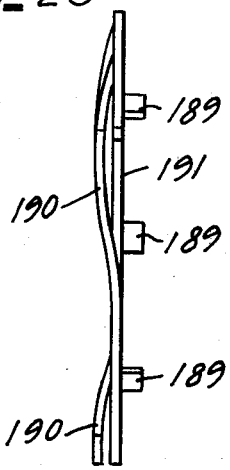
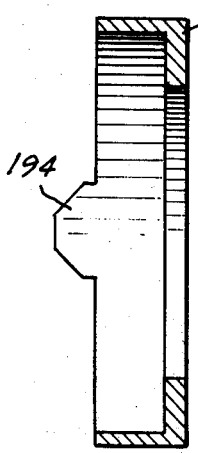
Fig. 24
Fig. 25
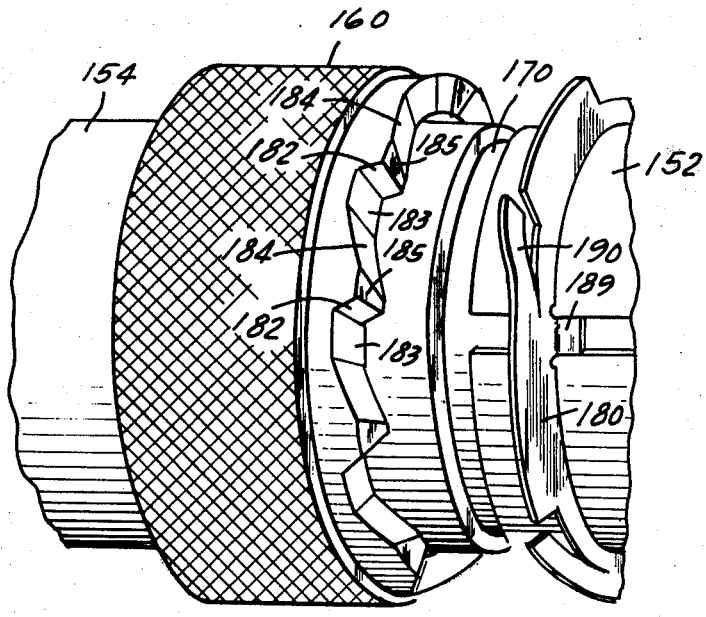

ELECTRICAL CONNECTOR WITH MEANS FOR MAINTAINING A CONNECTED CONDITION

BACKGROUND OF THE INVENTION

1. Field of the Invention

The present invention relates to electrical connectors, and more particularly to such connectors which are provided with means for releasably maintaining them in connected condition, so that they do become uncoupled inadvertently in response to shock, vibration or the like. Such connectors are sometimes referred to as a "non-decoupling" type of connector.

2. The Prior Art

It has become conventional in the prior art to provide safety wiring or lock wiring to prevent inadvertent disconnection of the connector. The safety wiring takes the form of a wire which is physically wrapped or tied about a portion of the plug shell and a portion of the receptacle shell, to prevent them from becoming disconnected. It is somewhat inconvenient to manipulate this wiring, and it is particularly difficult to install and inspect the condition of the wiring when the connector is in a location which is not readily accessible. It is therefore desirable to provide other means, which is more convenient to install and inspect, for insuring the maintenance of the connection between the plug shell and the receptacle shell.

SUMMARY OF THE INVENTION

Accordingly, it is the principal object of the present invention to provide improved means for maintaining the plug shell and the receptacle shell in connected relationship.

It is another object of the present invention to provide such apparatus which is easily manipulated by an operator during connection and disconnection of the connector.

A further object of the present invention is to provide such apparatus, which does not require materials which are used up or which must be replaced each time the connection is made.

Another object of the present invention is to provide means for insuring against an inadvertent disconnection of the connector, together with means for readily indicating visually the status of the connector.

These and other objects and advantages of the present invention will become manifest upon an inspection of the accompanying drawings and the following description.

In one embodiment of the present invention there is provided a connector having a plug shell, a receptacle shell, a coupling nut adapted to selectively threadably connect the plug shell and receptacle shell together, and a coupling sleeve overlying the coupling nut and adapted to selectively cooperate therewith to prevent the coupling nut from rotating relative to the plug shell and the receptacle shell when the sleeve is in one position relative to the plug shell, but to permit rotation of the coupling nut when the sleeve is moved to another position relative to the plug shell.

In another embodiment of the present invention there is provided a connector having a plug shell, a receptacle shell, a coupling nut adapted to selectively threadably interconnect the plug shell and the receptacle shell together, the coupling nut having a cam surface thereon, and a retaining spring cooperating with said cam surface normally to permit rotation of the coupling nut in a coupling direction but to prevent rotation of the nut in the other direction, and a spring retaining member adapted to selectively disengage the spring from the cam surface to permit the coupling nut to be rotated in the uncoupling direction.

In yet another embodiment of the present invention, a connector is provided having a plug shell, a receptacle shell, a coupling nut for selectively threadably interconnecting the plug shell and the receptacle shell together, the coupling nut having a cam surface thereon, and a retaining spring cooperating with said cam surface to permit rotation of the coupling nut in the coupling direction more readily than in the uncoupling direction.

BRIEF DESCRIPTION OF THE DRAWINGS

Reference will now be made to the accompanying drawings in which:

FIG. 11 is a side view, partly in cross-section, of an alternative embodiment of the present invention;

FIG. 12 is a side elevation of a plug shell employed in the apparatus of FIG. 11;

FIG. 13 is an end view of the coupling nut employed in the apparatus of FIG. 11;

FIG. 14 is a plan view of a release spring employed in the apparatus of FIG. 11, shown in flat condition;

FIG. 15 is a side view of the release spring of FIG. 14, shown in its normal arcuate condition;

FIG. 18 is a side view, partly in cross-section, of an additional embodiment of the present invention;

FIG. 19 is a side view of a plug shell employed in the apparatus of FIG. 18;

FIG. 20 is a side elevation of the coupling nut employed in the apparatus of FIG. 18;

FIG. 21 is an end view of the coupling nut illustrated in FIG. 20;

FIG. 22 is a plan view of a release spring employed in the apparatus of FIG. 18;

FIG. 23 is an end view of the release spring of FIG. 22;

FIG. 24 is a vertical cross-section of a spring retainer employed in the apparatus of FIG. 18; and FIG. 25 is a partial perspective view of the apparatus of FIG. 18.

DESCRIPTION OF THE PREFERRED EMBODIMENTS

Figure 1:
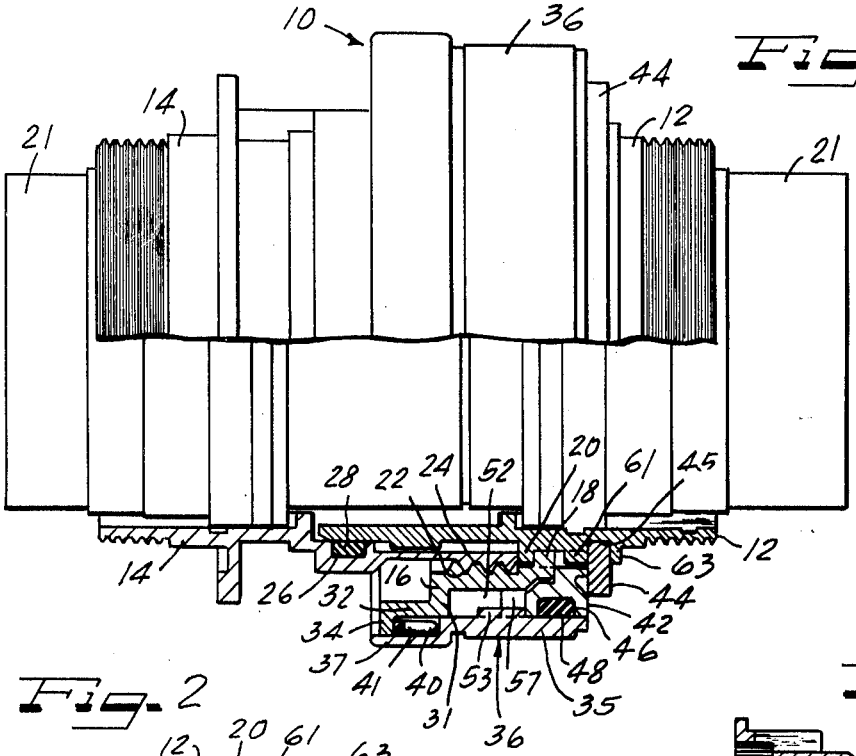
FIG. 1 is a side elevation, partly in cross-section, illustrating the construction of an exemplary embodiment of the present invention.
Figure 2:
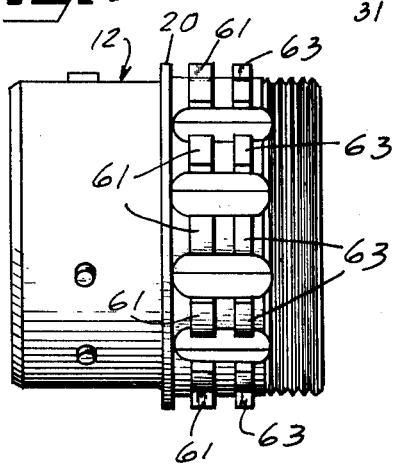
FIG. 2 is a side elevation of the plug shell employed in the apparatus of FIG. 1.
Figure 3:
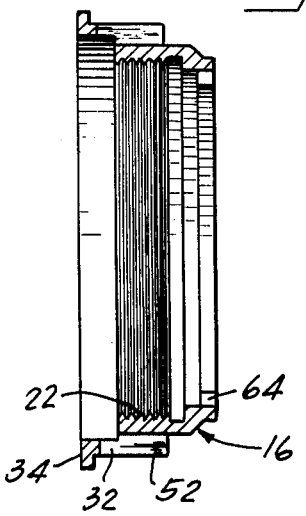
FIG. 3 is a vertical cross-section of a coupling nut employed in the apparatus of FIG. 1.
Figure 4:
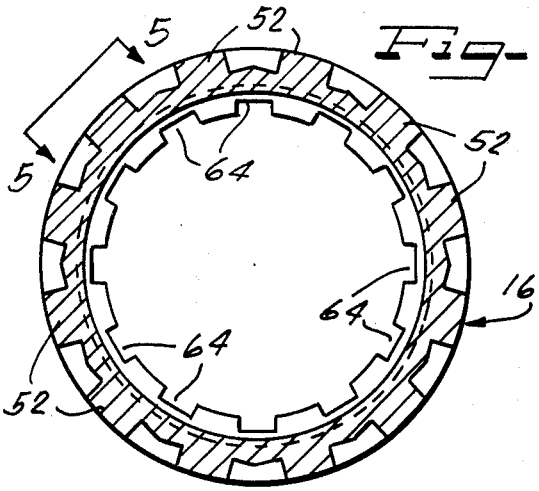
FIG. 4 is a cross-section of the coupling nut of FIG. 3 taken in a plane 4—4.
Figure 5:
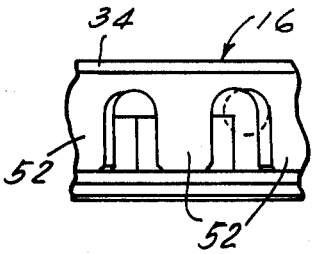
FIG. 5 is a partial side elevation of the coupling nut of FIG. 4 taken from the plane 5—5.
Figure 6:
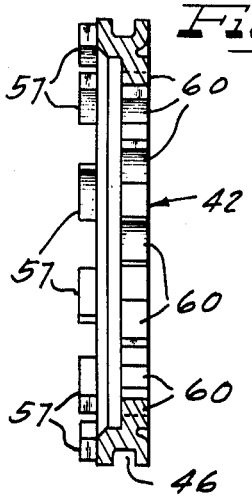
FIG. 6 is a side elevation of the lock ring employed in the apparatus of FIG. 1.
Figure 7:
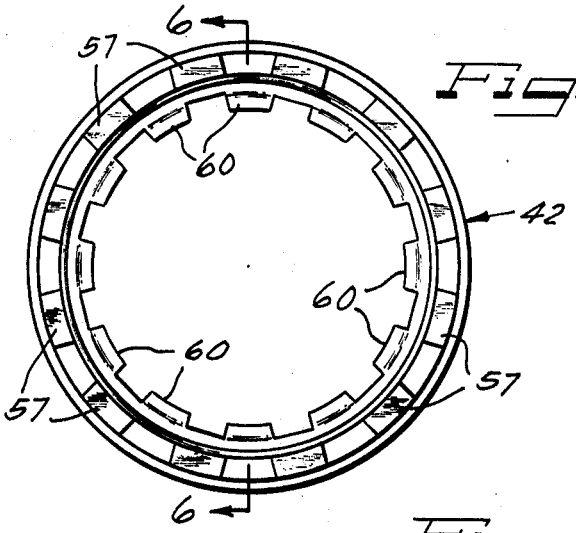
FIG. 7 is an end view of the lock ring of FIG. 6.
Figure 8:
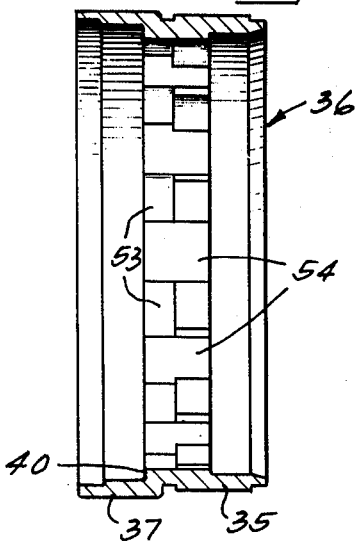
FIG. 8 is a vertical cross-section of a coupling sleeve employed in the apparatus of FIG. 1 taken along the plane 8—8 of FIG. 9.
Figure 9:
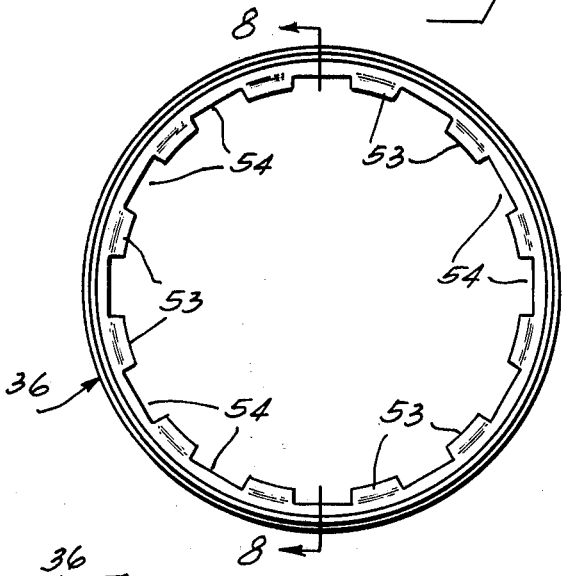
FIG. 9 is an end view of the coupling sleeve illustrated in FIG. 8.
Figure 10:
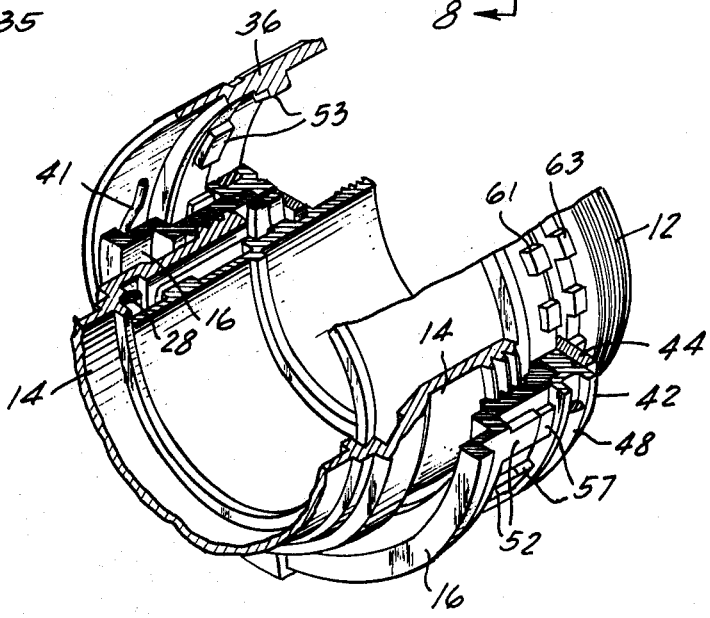
FIG. 10 is a partial perspective view of the apparatus illustrated in FIG. 1.

Referring now to FIG. 1, which is a side view partially in cross-section, of a first embodiment of the present invention, the basic components of the connector 10 are a plug shell 12, a receptacle shell 14 and a coupling nut 16, the nut 16 having an inwardly extending flange 18 which is trapped behind an outwardly extending flange 20 of the plug shell 12, and having inner threads 22 adapted to cooperate with corresponding outer threads 24 provided on the receptacle shell 14.

The plug shell 12 and the receptacle shell 14 are brought into coupling relationship by inserting the end of the plug shell 12 into the open end of the receptacle shell 14, and connected by turning the coupling nut 16 which draws the two shells tightly together until the end of the receptacle shell 14 engages the forward side (left-hand as illustrated in FIG. 1) of the flange 20. The two shells 12 and 14 normally contain inserts 21 which carry electrical conductors, so that an electrical connection is established between the conductors of the plug shell and the conductors of the receptacle shell in the standard manner. The details of the inserts have been omitted from all of the drawings in the interests of clarity.

Near the end of the receptacle shell 14, about the interior thereof, a groove 26 is provided to accommodate an O ring 28 or the like. The O ring 28 provides a seal between the plug shell 12 and the receptacle shell 14. By means of the O ring 28, the connection between the receptacle shell 14 and the plug shell 12 is made water-tight so that the conductors are protected from moisture.

The coupling nut 16 has at its forward end, an outwardly extending flange 31, to which the rear end of a tubular section 32 is connected, the forward end of the tubular section 32 being connected with an outwardly extending flange 34.

A coupling device 36 is formed of a rear tubular part 35 and a forward tubular part 37. The forward tubular part 37 surrounds the flange 34, and is adapted for axial sliding motion relative thereto. The two parts 35 and 37 of the sleeve 36 are connected by an interior shoulder 40. A return spring 41 is trapped between the flange 34 and the shoulder 40, and serves to urge the sleeve 36 rearwardly to the position illustrated in FIG. 1. The sleeve 36 may be urged forwardly by manual pressure, during coupling and uncoupling, in a manner which is described hereinafter.

A lock ring 42 surrounds the plug shell 12 at a position rearwardly of the flange 18 of the coupling nut 16, and maintains the latter in the position illustrated in FIG. 1, with flanges 18 and 20 in abutting relationship. A snap ring 44 disposed in a groove 45 of the plug shell 12, maintains the lock ring 42 in the position illustrated, trapped between the flange 18 and the lock ring 44. The lock ring 44 has an annular groove 46 in which an O ring 48 or the like is disposed, which is in sealing relationship with the interior surface of the rear tubular part 35 of the coupling sleeve 36. By means of the O ring 46, the interior of the coupling sleeve 36 is protected from moisture.

The various components of the connector are provided with splines which normally prevent relative motion of the coupling nut 16 when the coupling sleeve 36 is in the position illustrated in FIG. 1. However, when the coupling sleeve 36 is moved forwardly until a group of inwardly extending projections 53 are juxtaposed with the rear surface of the flange 31 of the coupling nut 16, the coupling nut is then free to turn relative to the shells 12 and 14, to perform coupling or uncoupling. There is a splined connection between the coupling sleeve and the coupling nut 16 for either position of the sleeve 36, so that rotation of the coupling sleeve is effective to turn the coupling nut.

The coupling nut 16 is provided with twelve outwardly projecting splines 52 equally spaced about the periphery of the nut 16, which splines cooperate with twelve equally spaced recesses 54, provided between inwardly projecting splines 53. The splines 52 and 53 establish a connection between the nut 16 and the sleeve 36, whereby the nut 16 and the sleeve 36 rotate together about a common axis but the sleeve 36 may slide axially relative to the coupling nut 16. The splines 53 and 54 also cooperate with a set of twelve splines 57 equally spaced about the periphery of the lock ring 42. The splines 52 and 57 are of substantially the same radial height and tangential width, so that they line up with each other and form continuous grooves therebetween receiving the splines 53 of the coupling sleeve 36, so the sleeve may be freely shifted in an axial direction. When the coupling sleeve 36 is manually urged forwardly, the splines 53 are free of the splines 57 of the lock ring 42, and so the coupling sleeve 36 and the nut 16 may be freely rotated.

The lock ring 42 is held in non-rotating position with respect to the plug shell 12 by means of twelve inwardly extending splines 60, equally spaced about the interior of the ring 42, and which are trapped by outwardly extending splines 61 in the plug shell 12.

The groove 45 which receives the snap ring 44, is defined by the rearward ends of the splines 61 and the forward ends of a set of projections 63 which are axially aligned with the splines 61.

The flange 18 of the coupling nut 16 is provided with twelve grooves 64, equally spaced about its interior surface, to allow the coupling nut to be slipped into position on the plug shell 12, past the splines 61 and 63.

The condition of the connector 10 illustrated in FIGS. 1–10 can be verified visually, since, in the locked condition, the rear end surface of the coupling sleeve 36 is flush with the rear surface of the lock ring 42. In a relatively inaccessible location, this condition of the connector 10 can be verified by feel if necessary. As long as the sleeve 36 and the lock ring 42 are flush, the connector cannot be uncoupled accidentally by shock or vibration.

Referring now to FIGs. 11–18, in which a second embodiment of the present invention is illustrated the connector 80 comprises a plug shell 82 and a receptacle shell 84, similar to the plug shell 12 and the receptacle shell 14 of the connector 10 illustrated in FIG. 1. The plug shell 82 is adapted to fit within the interior of the end of the receptacle shell 84 and an O ring 86 or the like is positioned in a groove on the interior of the outer portion of the plug shell 84, in order to form a moisture tight seal between the two shells when they are in their assembled condition, as shown in FIG. 11. The receptacle shell 84 has outer threads 88 which cooperate with inner threads 90 provided on the interior of a coupling nut 92.

The coupling nut 92 is generally tubular in shape, and has an inwardly extending flange 94 which is adapted to engage an outwardly extending flange 96 provided on the outer surface of the plug shell 82. The flange 96 is slightly less in diameter than the inner surface of the nut 92 just forward of the flange 94, so the flange 96 acts as a bearing to allow the nut 92 to rotate freely.

A spring retainer 100 is provided rearwardly of the coupling nut 92, and has a forwardly extending tubular portion 101 which encircles the rear end of the coupling nut 92. The inner diameter of the tubular portion 101 is slightly greater than the outer diameter of the rear end of the nut 92, so the retainer 100 rotates freely on the nut 92. A snap ring 102, provided in a groove 104 of the plug shell 82, holds the spring retainer 100 in the position shown in FIG. 11. The spring retainer 100 has a conical shoulder 106 facing the rear end of the coupling nut 92, and a spring 108 is disposed in the space 107 between the end of the coupling nut 92 and the conical shoulder 106.

The spring 108 cooperates with a cam surface provided on the rear face of the coupling nut 92 to permit the coupling nut 92 to rotate in the coupling direction but normally to prevent rotation of the nut 92 in the uncoupling direction. For this purpose the rear surface of the coupling nut 92 is provided with a plurality of rearwardly extending cam projections 110 (FIGS, 13 and 17), separated by grooves 111. The projections 110 extend axially from a shoulder surface 112 provided near the rear end of the coupling nut 92. Each of the projections 110 has an outer peripheral surface coextensive with the cylindrical forward surface of the coupling nut 92. The grooves 111 are each oriented at an oblique angle, so as to form an acute angle with the inner surface 114 of one projection 110 and an obtuse angle with the surface 114 of the adjacent projection 110. The inner surfaces 114 of the projections 110 are generally concentric with and spaced from the outer surface of the plug shell at this location to define a gap 116. The surface varies slightly from concentricity however, in that the ends of the projections 110 having the obtuse angles formed by the grooves 111 are spaced radially outward further than the ends having the acute angles. The inclined surfaces 114 (relative to concentricity) function to cam the spring 108 in the manner described hereinafter. The projections 110 selectively prevent rotation of the coupling nut 92 in the uncoupling direction.

The spring 108 is illustrated in stretched out flat condition in FIG. 14, and in the arcuate condition in which it is actually used in FIG. 15. The spring 108 comprises a relatively straight flat strip portion 120 from which a pair of tabs 122 project from one edge. The tabs 122 each have a flap 126 secured to one side thereof, the flaps being free from the strip portion 120 by means of the cut lines 128. The spring 108 has two additional tabs 124 which project from the same edge as do the tabs 122, but are without flaps. When the spring 108 is bent into its arcuate condition as illustrated in FIG. 15, the flaps 126 extend outwardly relative to the circular arc formed by the strip portion 120 of the spring 108. Accordingly, the free ends of the flaps 126 are adapted to bear on the inner surface 114 of the projections 110. When the nut 92 is rotated in a coupling direction, rotation of the nut 92 is clockwise as seen in FIG. 13, and the surfaces 114 easily ride over the ends of the flaps 126. However, when the nut 92 is rotated in its uncoupling direction the ends of the tabs 126 bear against the ends of the projections 110 having the obtuse angle, within the grooves 111, and effectively prevent rotation of the nut 92. The tabs 126 do not form a right angle with the side wall of the grooves 111, so that rotation of the coupling nut 92 in the uncoupling direction is possible, although difficult. Means is provided, however, to facilitate uncoupling when desired.

Figure 16:
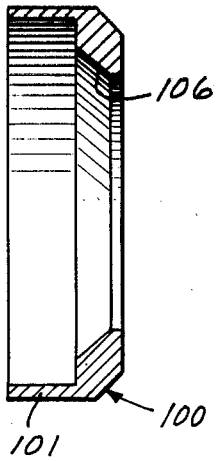
FIG. 16 is a vertical cross-section of a spring retainer employed in the apparatus of FIG. 11.
Figure 17:
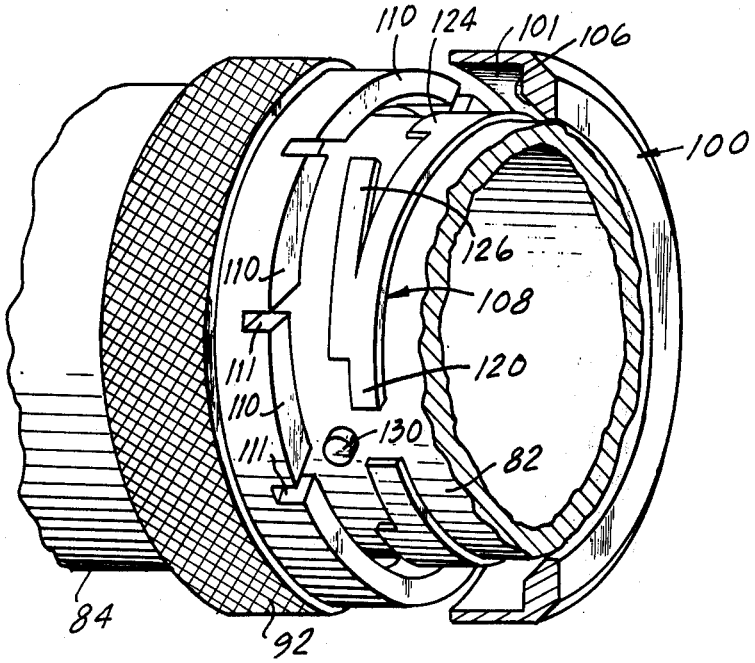
FIG. 17 is a partial perspective view of the apparatus illustrated in FIG. 11.

As best seen in FIG. 16, the spring retainer 100 is provided with a conically shaped inner surface 106 bears against the rear edge of the spring 108. When the spring retainer 100 is in the position illustrated in FIG. 11, the spring 108 is maintained in position against rotation relative to the plug shell 82 by a stud 130 mounted on the plug shell and extending outwardly therefrom. The spring 108 is wrapped around the plug shell 82 with the two ends of the spring 108 disposed on opposite sides of the stud 130, as shown in FIG. 17. A groove 131 is provided on the interior of the coupling nut 92 to allow the nut to clear the stud 130 during assembly.

As long as the spring retainer 100 is in the position illustrated in FIG. 11, the flaps 126 bear outwardly on the projections 110. When the spring retainer 100 is shifted forwardly, however, the interior conical surface 106 cams the spring 108 radially inwardly, thus withdrawing the flaps 126 from engagement with the interior surfaces 114 of the projections 110. When the spring retainer 100 is moved forwardly as far as possible, to close the space 107, the spring 108 is forced inwardly as described far enough so that the coupling nut 92 is free to rotate in the decoupling direction. In this way the plug shell and the receptacle shell may be separated easily, when desired, while being protected against accidental disconnection.

When the spring retainer 100 is in its locked position, this may be verified visually, or by feel, by the presence of a definite groove 132 between the nut 92 and the spring retainer 100. This groove is much narrower and less prominent when the spring retainer 100 is moved forward to its unlocking position.

In a third embodiment of the present invention, illustrated in FIGS. 18–25, a connector 150 has a plug shell 152, a receptacle shell 154 and a coupling nut 160 which are interrelated in generally the same manner as described above for the other two embodiments. An annular notch 162 is provided on the interior surface of the coupling nut 160, near its rearward end, and a split snap ring 164 is disposed partly in the notch 162 and partially in an annular groove 166 provided in the exterior surface of the plug shell 152. During assembly, the split ring 164 is retained in the groove 162 while the nut 160 is slipped over the rear end of the plug shell 152, and then snaps inwardly into the groove 166 to assume the position shown in FIG. 18, after which it holds the nut 160 firmly in place relative to the plug shell 152.

A second snap ring 168 is disposed in an annular groove 170 provided in the exterior surface of the plug shell 152 at a position spaced rearwardly from the groove 166. Between the snap ring 168 and the rear flange-like portion of the coupling nut 160, there is disposed a spring retainer 172 having a forwardly extending tubular portion 174 and a rearward flange portion 176. The interior of the tubular portion 172 bears on the outer circular cylindrical surface 175 of the rear portion of the coupling nut 160 and is supported thereby. A shoulder 171, between the surface 175 and the forward portion of the nut 92 maintains the spring retainer 172 in the position illustrated in FIG. 18. In the space between the coupling nut 92 and the flange portion 176 of the spring retainer 172, there is disposed a spring 180 which is adapted to cooperate with a cam surface provided on the rear face of the coupling nut 160.

The rear face of the coupling nut 160 is best shown in FIGS. 21 and 25. The cam surface is divided into nine equal sectors each having a tooth-like cam projection. Each projection has a steep face or surface 182 which rises from a lower forward flat surface 183 to one edge of an upper rearward flat surface 184. The outer edge of the upper flat surface 184 is connected by a gradually sloping surface 185 to the next successive lower flat surface 183, and so on. Although all of the surfaces 182–185 are plane, or flat, the so-called flat surfaces 183 and 184 are both oriented in planes which are normal to the axis of rotation of the nut 160.

The spring 180 is illustrated in detail in FIGS. 22 and 23. It is formed as a part of a flat sheet of resilient metal. The body of the spring is composed of an annularly shaped body 188. A plurality of tabs 189 are provided integrally with the interior edge of the annular number 188 and extend at right angles away from the plane of the body 188. At the periphery of the body 188 three arcuate 190 arms are separated from the body 188 by means of slits 191 and are bent outwardly from the plane of the body 188 so that the ends 192 of the arms 190 are spaced from the plane defined by the body 188. The spring 180 is positioned relative to the rear surface of the coupling nut 160 so that the end sections 192 of the arms 190 can bear on the steep cam surface 182. Thus, when the coupling nut 160 is rotated counterclockwise (as viewed in FIG. 21), so that the steep surfaces 182 are forced towards the ends of the spring arms 190, a relatively great resistance to turning is encountered, as a result of frictional force between the end of the spring arm 190 and the cam surface. Turning of the coupling nut 160 in the other direction however is unimpeded because the arms 190 gently cammed by the sloping surfaces 185 away from the coupling nut 160. The slope of the steep surfaces 182, although great, is not as great as to prevent uncoupling of the connector, manually, with effort. It does effectively prevent accidental uncoupling, however, as a result of shock or vibration. The amount of torque required to uncouple the connector may be selected by chosing an appropriate angle of slope for the steep surfaces 182.

The spring retainer 172 has a tab 194 which engages a recess 196 provided in the nut 160, to lock these members together as they rotate as a unit.

A plurality of grooves 198 are spaced around the periphery of the plug shell 152, to receive the tabs 189 of the spring 180, and prevent the same from rotating relative to the plug shell.

When the connector of FIGS. 18-25 is in the fully connected position, a slight gap or groove 200 is formed between the shoulder 171 of the nut 160, and the forward end of the portion 174 of the spring retainer 172. This groove is formed as a result of the nut 160 being urged forwardly, by the cooperating threads 156 and 158 on the nut 160 and the receptacle shell nut 154, respectively, while the spring retainer 172 is maintained in its rearward position against the lock ring 172. The presence of the groove 200 confirms visually and by feel, the coupled and locked condition of the connector, because the snap ring 164 is slightly warped, so as to maintain the grooves 162 and 166 in aligned relation until a sufficient force is produced during connection to flatten the ring 164 and open the groove 200.

It is apparent that all of the embodiments described above perform the function of maintaining a connected condition between a plug shell and a receptacle shell against inadvertent disconnection, and that means is provided to confirm, visually and by feel, the existence of the coupled and locked condition.

We claim as our invention:

1. In a connector having a plug shell, a receptacle shell, and a coupling nut, said coupling nut being mounted for rotation relative to one of said shells and having threads adapted to cooperate with corresponding threads on the other of said shells, the combination comprising a plurality of projections extending axially outwardly from the end of said coupling nut, restraining means including a resilient member connected with said one shell and urged into contact with said projections for impeding rotation of said coupling nut, a retainer member mounted on said one shell on the side of said resilient member remote from said coupling nut for maintaining said resilient member in juxtaposition with said coupling nut, said coupling nut and said retainer member being axially movable relative to each other, whereby the position of said retainer member relative to said coupling nut furnishes a visual indication of the state of said connector, said one shell having an external peripheral groove and said coupling nut having an internal groove aligned therewith, and a snap ring partly disposed in each of said grooves to maintain said coupling nut in mounted relation to said one shell, said snap ring having an axial dimension less than the axial dimension of at least one of said grooves, whereby said coupling nut is shiftable on said one shell between a first position in which said snap ring engages one side of the groove on the coupling nut and the opposite side of the groove on said one shell, and a second position in which said snap ring engages the other side of the groove on the coupling nut and the opposite side of the groove on said one shell.

2. Apparatus according to claim 1, wherein said snap ring is warped, whereby the groove on the coupling nut is normally maintained in aligned relation with the groove on said one shell.

3. In an electrical connector having a plug shell, a receptacle shell, each of said shells receiving a plurality of electrical conductors and a coupling nut, said coupling nut being mounted for rotation relative to one of said shells and having threads adapted to cooperate with corresponding threads on the other of said shells, the combination comprising a plurality of projections extending axially outwardly from the end of said coupling nut, restraining means including a resilient member connected with said one shell and urged into contact with said projections for impeding rotation of said coupling nut, a retainer member mounted on said one shell at the side of said resilient member remote from said coupling nut for maintaining said resilient member in juxtaposition with said coupling nut, said one shell having an external peripheral groove and said coupling nut having an internal groove aligned therewith, and a snap ring partly disposed in each of said grooves to maintain said coupling nut in mounted relation to said one shell, said restraining means comprising a resilient leaf spring interposed between said coupling nut and said retainer member, said leaf spring being in compression between said projections and said retainer member so that at least a portion of said leaf spring bears against said projections, said leaf spring having an elongate arm which is inclined relative to a plane normal to the axis of said coupling nut, said arm having one end in contact with said projections and its other end supported at a position which is free of said projections, whereby said arm is cammed away from said projections when said nut is rotated in one direction, said arm impeding but not preventing rotation of said nut in the other direction, said projections comprising a plurality of ratchet-like teeth carried by said coupling nut, said plurality of teeth being separated from one another by a plurality of surface portions, said surface portions being normal to the axis of rotation of said coupling nut; each of said teeth having forward and rearward faces, said forward faces each having a steeper angle than said rearward faces, both of said faces being inclined to the axis of rotation of said coupling nut, the end of said arm bearing against said forward face to impede rotation of said coupling nut in said other direction, and said rearward face camming said arm away from said coupling nut when said coupling nut is rotated in said one direction.

4. In a connector having a plug shell, a receptacle shell, and a coupling nut, said coupling nut being mounted for rotation relative to one of said shells and having threads adapted to cooperate with corresponding threads on the other of said shells, the combination comprising a plurality of projections extending axially outwardly from the end of said coupling nut, restraining means including a resilient member connected with said one shell and urged into contact with said projections for impeding rotation of said coupling nut, a retainer member mounted on said one shell at the side of said resilient member remote from said coupling nut for maintaining said resilient member in juxtaposition with said coupling nut, said one shell having an external peripheral groove and said coupling nut having an internal groove aligned therewith, and a snap ring partly disposed in each of said grooves to maintain said coupling nut in mounted relation to said one shell, said retainer member being keyed to said coupling nut for rotation therewith.

5. Apparatus according to claim 4, wherein the surface of said coupling nut is provided with an axially extending notch and said retainer member is provided with an axially extending projection adapted to be received into said notch, whereby said retainer member and said coupling nut rotate together.

* * * * *